US008893903B2

(12) United States Patent
Nilsson

(10) Patent No.: US 8,893,903 B2
(45) Date of Patent: Nov. 25, 2014

(54) RETROFITTING SYSTEM FOR SHELVES

(76) Inventor: Rickard Nilsson, Diez (DE)

( * ) Notice: Subject to any disclaimer, the term of this patent is extended or adjusted under 35 U.S.C. 154(b) by 1 day.

(21) Appl. No.: 13/819,348

(22) PCT Filed: May 25, 2011

(86) PCT No.: PCT/EP2011/002588
§ 371 (c)(1),
(2), (4) Date: Feb. 27, 2013

(87) PCT Pub. No.: WO2012/028217
PCT Pub. Date: Mar. 8, 2012

(65) Prior Publication Data

US 2013/0153524 A1 Jun. 20, 2013

(30) Foreign Application Priority Data

Sep. 3, 2010 (EP) ..... 10009164

(51) Int. Cl.
*A47F 5/00* (2006.01)
*A47B 57/58* (2006.01)

(52) U.S. Cl.
CPC ..... *A47F 5/00* (2013.01); *A47F 5/0056* (2013.01); *A47B 57/588* (2013.01)
USPC ..... 211/184; 211/135; 211/59.2; 211/134

(58) Field of Classification Search
CPC ..... A47F 5/005; A47F 5/0056; A47F 5/0063; A47F 5/01; A47F 5/13; A47F 5/132; A47F 5/10; A47F 5/101; A47F 5/0018; A47F 5/112; A47F 5/116; A47F 7/28; A47F 1/12; A47F 5/00; A47F 5/0043; A47F 5/16; A47B 57/58; A47B 57/581; A47B 57/583; A47B 57/585; A47B 57/586; A47B 57/588; A47B 73/002; A47B 55/02; A47B 47/02; A47B 47/021; A47B 47/03; A47B 96/02; A47B 96/021; A47B 96/04; A47B 45/00; A47B 96/025; A47B 73/00
USPC ..... 211/184, 181.1, 134, 135, 175, 74, 211/59.2; 108/60, 61
See application file for complete search history.

(56) References Cited

U.S. PATENT DOCUMENTS 2,529,826 A * 11/1950 Walker ..... 312/140
2,589,082 A * 3/1952 Hickey ..... 312/140.3
(Continued)

FOREIGN PATENT DOCUMENTS

| | | | |
|---|---|---|---|
| AU | 2008200144 | B1 | 11/2008 |
| DE | 19609432 | A1 | 9/1997 |
| EP | 1455620 | A1 | 9/2004 |

OTHER PUBLICATIONS

European Patent Office, International Search Report in International Patent Application No. PCT/EP2011/002588 (Sep. 8, 2011).

*Primary Examiner* — Jennifer E Novosad
(74) *Attorney, Agent, or Firm* — Leydig, Voit & Mayer, Ltd.

(57) ABSTRACT

A retrofitting system for shelves includes shelf rack inserts rack inserts each having a product slide plate with rectangular raised edges on a front and on a rear. The raised edge on the front includes a snapped-on U-rail having openings and the raised edge on the rear includes rectangular cutouts disposed opposite from the openings. At least one separating bracket has a front side and a rear side with two parallel and joined cross-bars extending between the front side and the rear side. The front side includes a horizontal pin and the rear side includes an insertion plate that is installed perpendicularly such that the separating bracket is configured to be locked in place at a lateral distance in the product slide plate by the insertion plate being inserted into a corresponding one of the cutouts and the pin being horizontally inserted into a corresponding one of the openings.

2 Claims, 6 Drawing Sheets

(56) References Cited

U.S. PATENT DOCUMENTS

| | | | | | |
|---|---|---|---|---|---|
| 2,915,193 | A | * | 12/1959 | Bromberg | 108/61 |
| 3,110,402 | A | * | 11/1963 | Mogulescu | 211/59.3 |
| 3,501,020 | A | * | 3/1970 | Krikorian | 211/184 |
| 3,512,652 | A | * | 5/1970 | Armstrong | 211/134 |
| 3,698,568 | A | * | 10/1972 | Armstrong | 211/184 |
| 4,346,806 | A | * | 8/1982 | Bustos | 211/59.4 |
| 5,464,103 | A | * | 11/1995 | O'Brien | 211/133.3 |
| 5,464,105 | A | * | 11/1995 | Mandeltort | 211/184 |
| 6,116,436 | A | * | 9/2000 | Ferrucci et al. | 211/187 |
| 2003/0034319 | A1 | * | 2/2003 | Meherin et al. | 211/184 |
| 2004/0256341 | A1 | * | 12/2004 | Donnell et al. | 211/187 |
| 2006/0096938 | A1 | * | 5/2006 | Kanou | 211/184 |
| 2006/0113262 | A1 | * | 6/2006 | Knorring et al. | 211/59.2 |

* cited by examiner

RETROFITTING SYSTEM FOR SHELVES

CROSS-REFERENCE TO RELATED APPLICATIONS

This application is a U.S. National Phase application under 35 U.S.C. §371 of International Application No. PCT/EP2011/002588, filed on May 25, 2011, and claims benefit to European Patent Application No. 10009164.4, filed on Sep. 3, 2010. The International Application was published in German on Mar. 8, 2012 as WO 2012/028217 under PCT Article 21(2).

FIELD

The present invention relates to a retrofitting system for shelves.

BACKGROUND

When it comes to conventional shelf systems and sliding-shelf systems, the product separators or compartment dividers are not adequately secured on the sides and they buckle if the products exert too much pressure. Sometimes, the compartment dividers consist of individual elements which have been inserted next to one another but which are not firmly attached to each other so that the product rack becomes unstable (DE 196 09 432). The shelves or shelf racks known so far have inserts with open slotted rails into which the compartment dividers in the form of brackets are inserted (U.S. Pat. No. 6,116,436). In the case of these systems as well, the compartment dividers do not provide adequate lateral support for the products. Low products roll or slide sideways underneath the brackets. If the brackets, as compartment dividers, were to be inserted only into the open slotted rails, they would not be sufficiently supported, so that for this system (U.S. Pat. No. 6,116,436), additional features that are laborious to produce, like holes into which the brackets can be inserted, have to be created so that the brackets can also be affixed horizontally. In the prior-art systems, the insertion of the brackets is complicated since they usually have to be pressed together using both hands in order to fit through the slots and, at the same time, to be inserted into the holes (U.S. Pat. No. 6,116,436). EP 1455620 solves this problem. EP 1455620 ensures a variable system with racks of shelves and especially sliding shelves according to the "first-in-first-out" method. In this manner, every conceivable type of product can be displayed while always ensuring that the products can slide. Furthermore, EP 1455620 ensures stability over the entire width of the shelf rack, thus preventing any slipping of the product dividers or of the stored products. The product separators ensure that the products reliably slide down in the compartment and also prevent sideways tipping, even when the adjacent compartment is empty. The compartment dividers or product separators in this system can be easily inserted with just one hand. The configuration consisting of several components and the special design of the rack frame as well as of the separating bracket calls for special measures of a technical nature that cannot be found in the existing systems. In particular, the system from EP 1455620 cannot be inserted into existing shelf racks since the fastening means for the product separator extends into the shelf base. Installing such a frame for the shelf rack, including the product slide plate into which the product separator is inserted, is not practicable since too much height is added to the product slide rails when such a system is installed. Furthermore, if EP 1455620 were configured as a retrofitting system, it would be technically extremely elaborate as well as costly to manufacture since it would have to be specially adapted and fit into the existing systems.

SUMMARY

In an embodiment, the present invention provides a retrofitting system for shelves that includes a plurality of shelf rack inserts. Each of the shelf rack inserts include a product slide plate having rectangular raised edges on a front and on a rear. The raised edge on the front includes a snapped-on U-rail having openings disposed at regular intervals from one another just above a bottom of the product slide plate, the openings being at least one of circular, oval, rectangular and square. The raised edge on the rear includes rectangular cutouts disposed opposite from the openings. At least one separating bracket has a front side and a rear side with two parallel and joined cross-bars extending between the front side and the rear side. The front side includes a horizontal pin that is at least one of circular, oval, rectangular and square and the rear side includes an insertion plate that is installed perpendicularly such that the at least one separating bracket is configured to be locked in place at a lateral distance in the product slide plate by the insertion plate being inserted into a corresponding one of the cutouts and the pin being horizontally inserted into a corresponding one of the openings opposite the corresponding one of the cutouts.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

In an embodiment, the present invention overcomes the above-described problems.

The invention, as a retrofitting system, makes it possible for the advantages of EP 1455620 to be retrofitted into existing systems, irrespective of their configuration.

Figure 1:
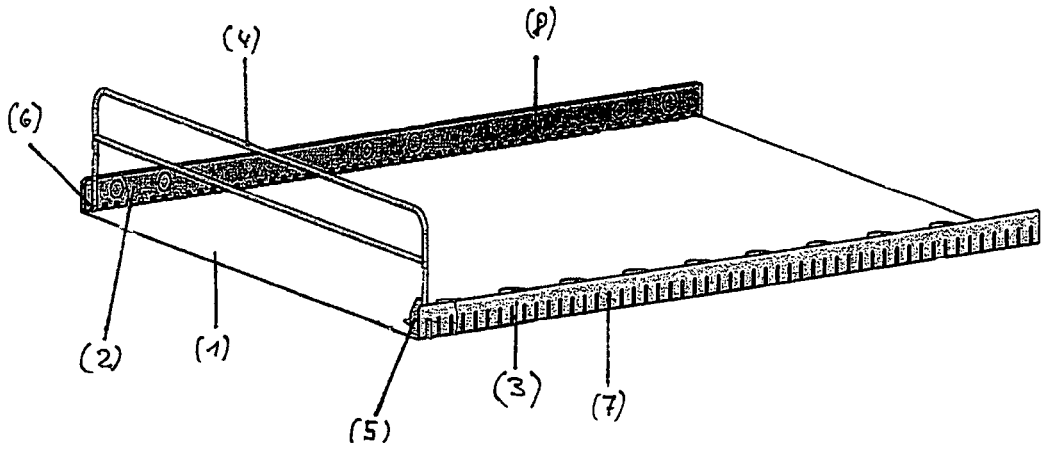
FIG. 1 shows a product slide plate and a separating bracket.
Figure 2:
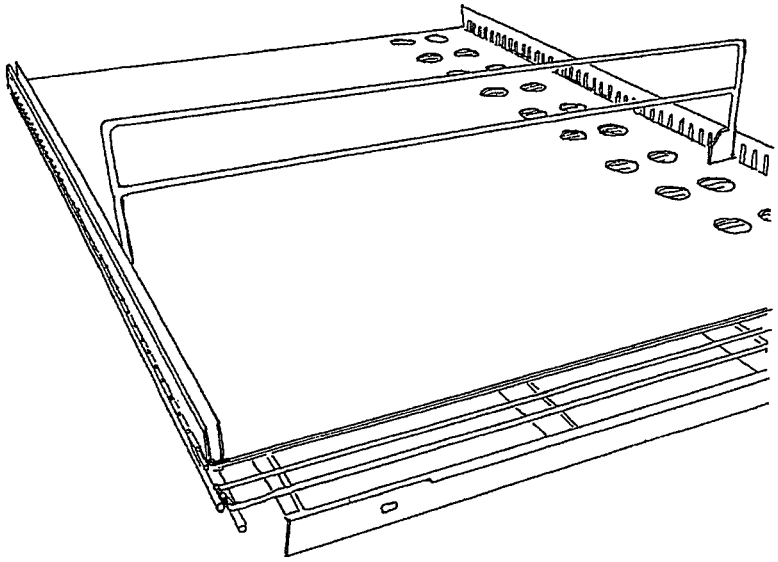
FIG. 2 shows the product slide plate and the separating bracket on an existing shelf rack.

The configuration of the product slide plate (1) according to an embodiment of the invention allows the product slide plate to be inserted into existing shelf racks (FIG. 2). The product slide plate according to an embodiment of the invention entails the advantage that the design with the rectangular raised edges on the front (2) and on the rear (3) allows the separating bracket itself to be accommodated without the need for the separating bracket to be passed through downwards, as is the case with EP 1455620 (FIG. 1).

Figure 3:
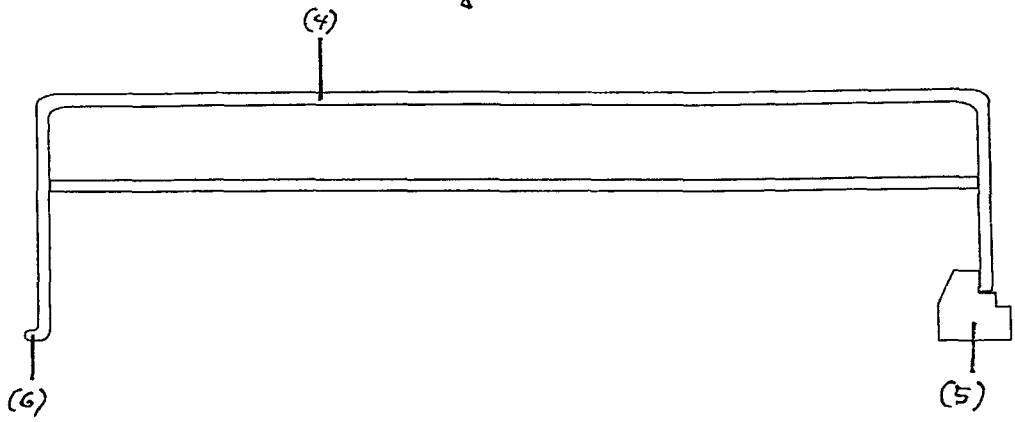
FIG. 3 shows the separating bracket.

The separating bracket (4) according to an embodiment of the invention (FIG. 3) has the advantage that, on one side, the insertion plate (5) is installed in such a way that it does not have to be inserted through the product slide plate downwards into the frame, but rather, said insertion plate (5) is merely inserted on one side into the rectangular cutouts (7) on the rear and the separating bracket is inserted on the front into the openings (8) which, depending on the design of the pin (6), correspond to said pin (6), so that, together with the product slide plate, it forms a uniform system that can be placed onto an existing frame for a shelf rack or onto an existing shelf rack. The design of the insertion plate ensures that, once it has been inserted, the separating bracket is laterally secured, preventing it from tilting away or tipping over, even when the compartments are filled only on one side. The configuration of the separating bracket with parallel cross bars has the advantage that, when the separating bracket is inserted into the product slide plate using one hand, it is pulled together on the cross bars, so that the distance between the insertion plate and the pin is reduced and the separating bracket is inserted into the openings under tension, likewise with one hand.

Figure 4:
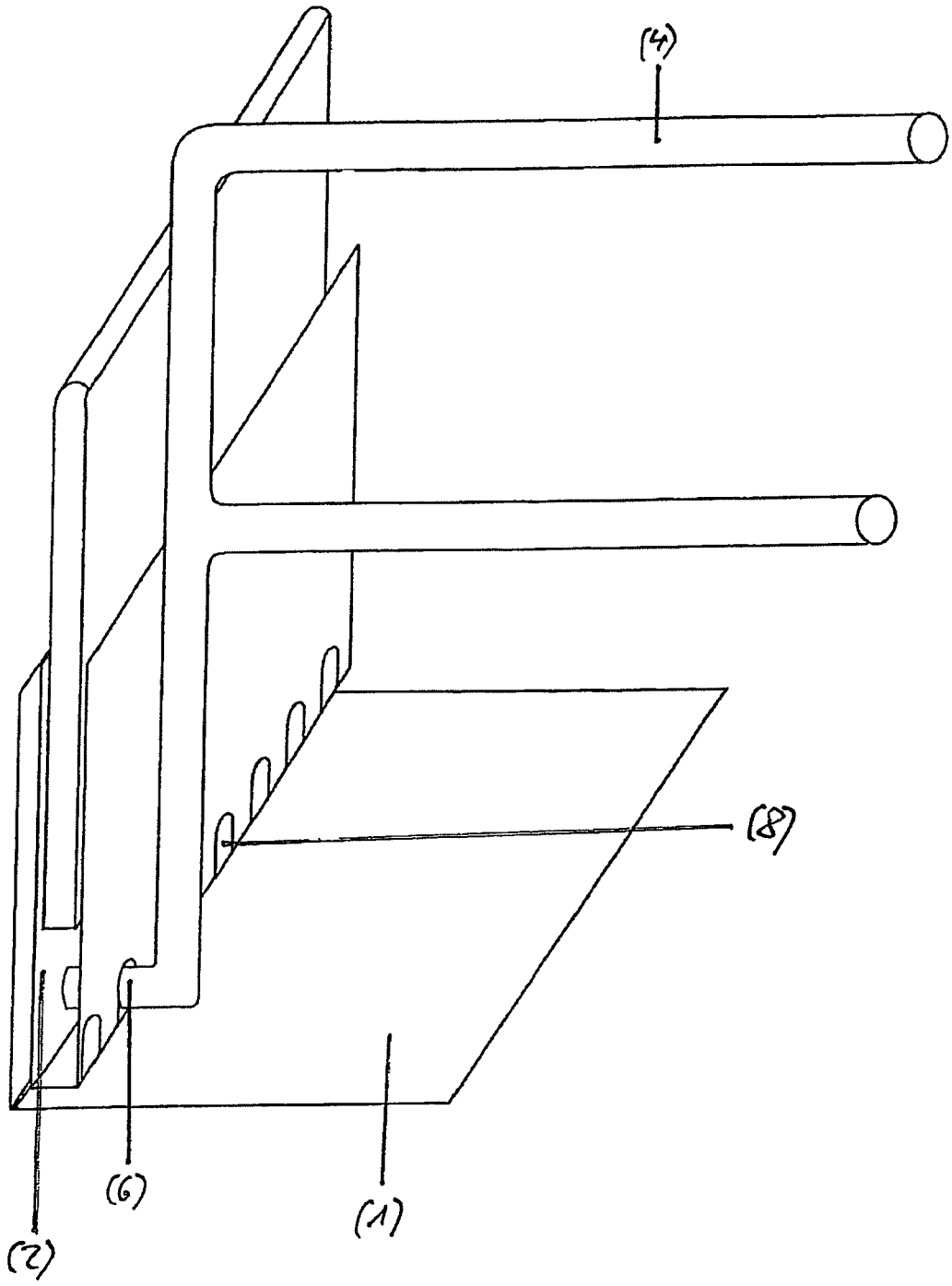
FIG. 4 shows a first view of a front side of the product slide plate and the separating bracket.
Figure 5:
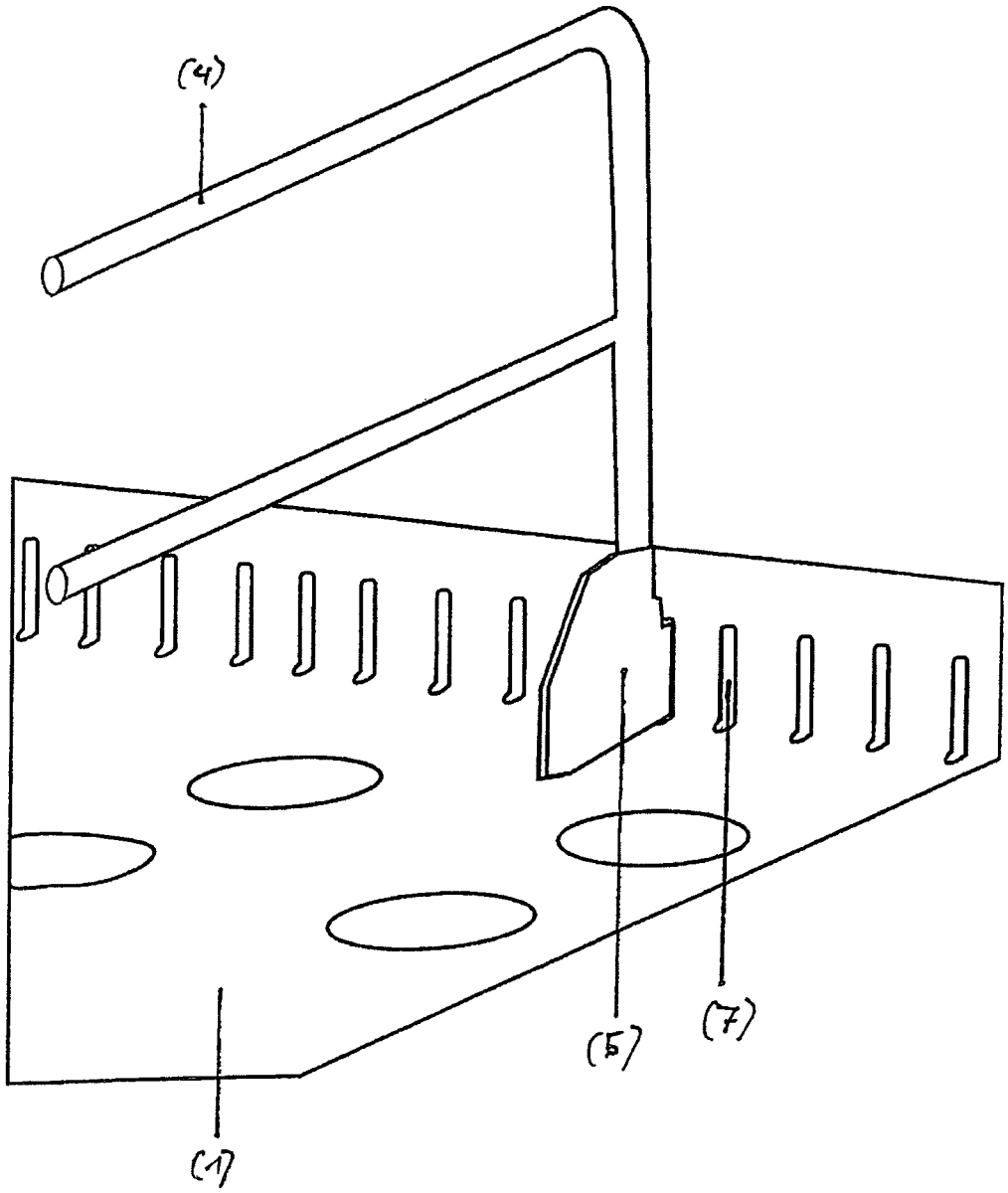
FIG. 5 shows a rear side of the product slide plate and the separating bracket.
Figure 6:
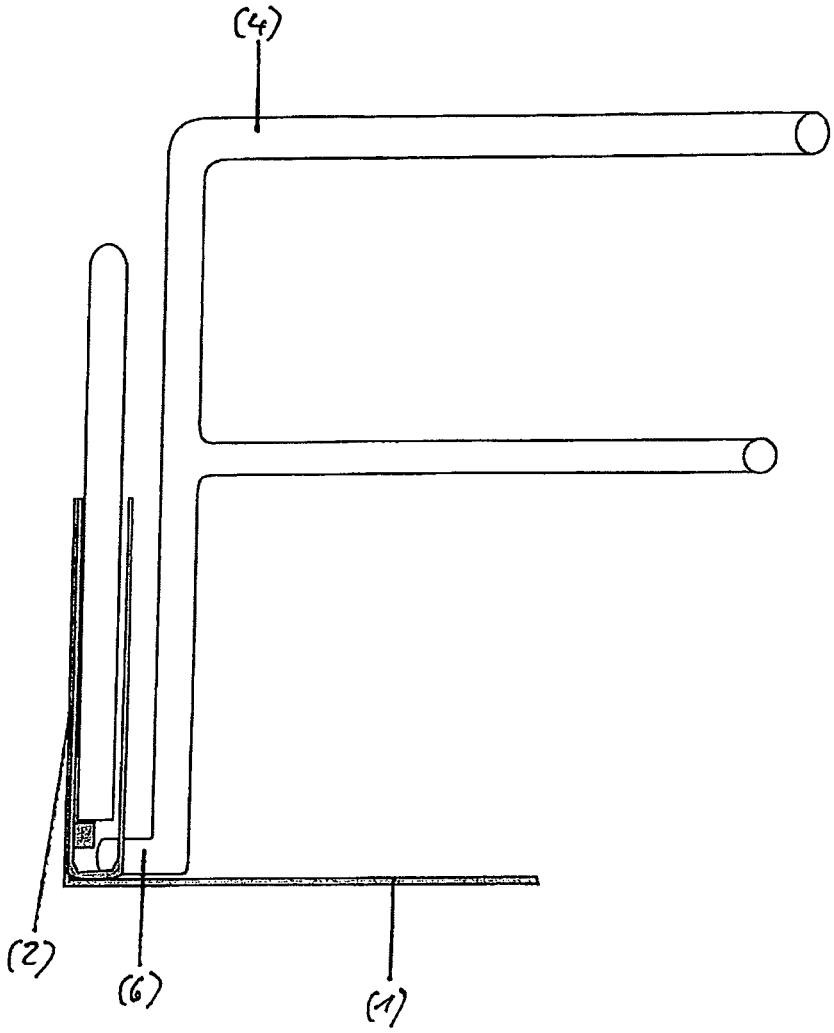
FIG. 6 shows a second view of a front side of the product slide plate and the separating bracket.

The separating bracket according to an embodiment of the invention, with the horizontal pin that is inserted only at a low height into the U-rail on the front raised edge of the product slide plate has the advantage that the U-rail can be configured on the front in such a way that enough space remains there to receive a product stop element at the removal end of the shelf rack (FIGS. 4, 5).

The U-rail according to an embodiment of the invention, which is installed on the front raised edge of the product slide plate, enhances the stability and torsional stiffness of the product slide plate. The front raised edge is stabilized and reinforced by the U-rail itself, so that a raised product stop element can be inserted into the U-rail and can withstand the greater pressure exerted by the products.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise

The invention claimed is:

1. A system for shelves comprising a plurality of shelf rack inserts, each of the shelf rack inserts comprising:

a product slide plate having a front side, a rear side, and a bottom, wherein the rear side has a rectangular upturned edge including rectangular cutouts disposed at regular intervals from one another just above the bottom of the product slide plate;

a U-rail placed on the bottom of the product slide plate and extending upwards so as to form a rectangular upturned edge at the front side of the product slide plate, the U-rail having openings disposed opposite from the rectangular cutouts, the openings being at least one of circular, oval, rectangular and square; and at least one separating bracket having a front side and a rear side with two parallel and joined cross-bars extending between the front side and the rear side, the front side including a horizontal pin that is at least one of circular, oval, rectangular and square and the rear side including an insertion plate that is installed perpendicularly to the product slide plate such that the at least one separating bracket is configured to be locked in place at a lateral distance in the product slide plate by the insertion plate being inserted into a corresponding one of the cutouts and the pin being horizontally inserted into a corresponding one of the openings opposite the corresponding one of the cutouts.

2. The retrofitting system according to claim 1, wherein the product slide plate is metal.

* * * * *